US008783378B2

(12) United States Patent
Zhou

(10) Patent No.: US 8,783,378 B2
(45) Date of Patent: Jul. 22, 2014

(54) AUTO HAMMER

(75) Inventor: Hongtao Zhou, Nanjing (CN)

(73) Assignee: Chervon Limited, Hong Kong (HK)

( * ) Notice: Subject to any disclaimer, the term of this patent is extended or adjusted under 35 U.S.C. 154(b) by 389 days.

(21) Appl. No.: 12/938,585

(22) Filed: Nov. 3, 2010

(65) Prior Publication Data

US 2011/0108298 A1 May 12, 2011

(30) Foreign Application Priority Data

Nov. 6, 2009 (CN) ..... 2009 2 0257444

(51) Int. Cl.

| | |
|---|---|
| ***B25D 9/00*** | (2006.01) |
| ***B25D 11/00*** | (2006.01) |
| ***B25D 13/00*** | (2006.01) |
| ***E21B 1/00*** | (2006.01) |

(52) U.S. Cl.

USPC ..... 173/91

(58) Field of Classification Search

CPC ..... B25D 1/00; B25D 2250/111; B25D 2250/241; B25D 9/04; B25C 1/047

USPC ..... 227/131, 63, 107; 173/46, 48, 213, 39, 173/91

See application file for complete search history.

(56) References Cited

U.S. PATENT DOCUMENTS

| | | | | |
|---|---|---|---|---|
| 2,079,909 | A | | 5/1937 | Corwill |
| 2,239,090 | A | | 4/1941 | Everett |
| 2,877,820 | A | | 3/1959 | Ristow |
| 3,160,217 | A | | 12/1964 | Raihle |
| 3,376,940 | A | | 4/1968 | Willis |
| 3,789,706 | A | | 2/1974 | Smith |
| 3,924,692 | A | | 12/1975 | Saari |
| 4,299,021 | A | | 11/1981 | Williams |
| 4,347,450 | A | * | 8/1982 | Colligan ..... 310/50 |
| 4,519,536 | A | * | 5/1985 | Steigauf ..... 227/147 |
| 4,533,077 | A | * | 8/1985 | Jochum ..... 227/156 |
| 4,607,709 | A | | 8/1986 | Walser |
| 4,611,739 | A | | 9/1986 | Rowton |
| 4,742,875 | A | | 5/1988 | Bell |
| 4,890,779 | A | * | 1/1990 | Giannuzzi ..... 227/139 |
| 4,908,909 | A | | 3/1990 | Akrenius |
| 4,955,984 | A | * | 9/1990 | Cuevas ..... 408/67 |
| 4,978,048 | A | * | 12/1990 | Purcell ..... 227/149 |
| 5,002,134 | A | | 3/1991 | Yamada |

(Continued)

FOREIGN PATENT DOCUMENTS

| | | |
|---|---|---|
| CN | 200410088827 | 10/2006 |
| CN | 201295910 Y | 8/2009 |

(Continued)

*Primary Examiner* — Robert Long

(74) *Attorney, Agent, or Firm* — Greenberg Traurig, LLP

(57) ABSTRACT

An auto hammer includes a housing having a grip, a head assembly arranged on one end of the housing, a motor mounted within the housing, a switch arranged on the housing for controlling the motor. The head assembly includes a striking device having a receiving cavity which comprises a locking mechanism. When the receiving cavity is retracted into the housing and locked by pressing the locking pin downwardly, with the striking rod being revealed to increase the visibility of the striking rod. During operation, the objects to be processed, such as tenons and bricks, may be impacted by the striking rod in a linear reciprocating manner, so that the function of the tool can be expanded, without being limited to knocking the fastening pieces into the objects to be processed.

22 Claims, 22 Drawing Sheets

(56) References Cited

U.S. PATENT DOCUMENTS

| | | | | |
|---|---|---|---|---|
| 5,025,869 | A * | 6/1991 | Terunuma et al. | 173/98 |
| 5,443,196 | A | 8/1995 | Burlington | |
| 5,794,325 | A | 8/1998 | Fallandy | |
| 5,940,977 | A | 8/1999 | Moores, Jr. | |
| 6,138,364 | A | 10/2000 | Schmitz | |
| 6,223,441 | B1 * | 5/2001 | Parsons | 30/367 |
| 6,250,401 | B1 | 6/2001 | Yamada | |
| 6,253,403 | B1 * | 7/2001 | Veschi | 7/165 |
| 6,431,430 | B1 | 8/2002 | Jalbert et al. | |
| 6,494,590 | B1 | 12/2002 | Paganini et al. | |
| 6,866,226 | B2 | 3/2005 | Pratt et al. | |
| 6,915,936 | B2 * | 7/2005 | Estes | 227/147 |
| 6,988,734 | B2 * | 1/2006 | Zierpka | 279/75 |
| 7,410,084 | B1 | 8/2008 | Reed | |
| 7,614,460 | B2 * | 11/2009 | Henriksson et al. | 173/109 |
| 7,878,383 | B2 * | 2/2011 | Marschel et al. | 227/148 |
| 8,016,048 | B2 * | 9/2011 | Ueda et al. | 173/176 |
| 8,186,554 | B2 * | 5/2012 | Abla | 227/148 |
| 2003/0098169 | A1 * | 5/2003 | Phillips et al. | 173/93.5 |
| 2007/0044983 | A1 * | 3/2007 | Wuensch et al. | 173/217 |
| 2007/0084616 | A1 | 4/2007 | Lam et al. | |
| 2007/0170224 | A1 * | 7/2007 | Erhardt et al. | 227/142 |
| 2007/0278276 | A1 * | 12/2007 | Wen | 227/130 |
| 2008/0087449 | A1 | 4/2008 | Lam et al. | |
| 2009/0266867 | A1 * | 10/2009 | Mina et al. | 227/151 |
| 2010/0034605 | A1 * | 2/2010 | Huckins et al. | 408/1 R |

FOREIGN PATENT DOCUMENTS

| | | | | |
|---|---|---|---|---|
| GB | 1501518 | | 2/1978 | |
| GB | 2474953 | | 5/2011 | |
| WO | 2006008546 | A2 | 1/2006 | |
| WO | WO 2006004547 | A1 * | 1/2006 | B25D 17/24 |

* cited by examiner

AUTO HAMMER

RELATED APPLICATION

This application claims the benefit of CN 200920257444.8, filed on Nov. 6, 2009, the disclosure of which is incorporated herein by reference in its entirety.

BACKGROUND

This invention relates to auto hammers and, more particularly, to a portable auto hammer.

Auto hammers are commonly used portable tools. There are various different types of auto hammers. In accordance with the type of the power source utilized, auto hammers may be generally divided into two types, i.e., pneumatic auto hammers and electric auto hammers. In accordance with the working environment, auto hammers may also be divided into single-strike-action types and continuous-strike-action types. Auto hammers of the single-strike-action type are generally used to strike nails of smaller dimensions into softer objects such as wood boards. When nails of large dimension are considered, or when the material of the objects to be fixed is hard, nails cannot generally be stricken into the object by a single-strike-action type auto hammer. In this situation, the nails tend to be bent or seized, or even to damage the tool. In this case, auto hammers of the continuous-strike-action type are desired.

SUMMARY

The invention provides an auto hammer comprising a housing having a grip, a head assembly arranged on one end of the housing, a motor mounted within the housing, and a switch arranged on the housing for controlling the motor. The head assembly includes a striking device having a receiving cavity which comprises a locking mechanism.

Furthermore, the locking mechanism comprises a locking pin mounted on the housing and a locking hole mounted on the receiving cavity. The receiving cavity may also be made from transparent material such as transparent plastic to increase the visibility of the striking rod. The user may use the tool as an auto hammer to strike the objects to be processed where he/she can see the specific position of the striking rod.

The auto hammer may also comprise a head assembly which includes a transmission mechanism and a striking device having a striking rod, and the transmission mechanism converts rotating motions of the motor into linear motions of the striking rod.

Furthermore, the gravity center of the auto hammer is located at the grip portion. The auto hammer according to this arrangement is more ergonomic so that users feel more comfortable when holding the hammer and spends less effort during operation.

Furthermore, the distance between the central axis of the striking rod and the top portion of the head assembly is between 5 mm and 26 mm, preferably 10.7 mm. This distance is arranged very small for allowing the auto hammer to be used closer to a base wall.

The material utilized for the head assembly of the auto hammer is different from that of the housing. Preferably, the hardness of the material utilized for the head assembly, such as TPE, is lower than that of the material of the housing, such as ABS. During operation, the material utilized for the head assembly makes the device feel more comfortable when held by hands.

The material utilized for the grip of the auto hammer is different from that of the housing. Preferably, the hardness of the material utilized for the grip, such as TPE, is lower than that of the material of the housing, such as ABS. During operation, the material utilized for the head assembly makes the device feel more comfortable when held by hands.

Furthermore, the auto hammer can be used between two surfaces perpendicular to each other and closer to the intersecting line of the two surfaces. To this end, the auto hammer comprises a housing having an upper portion, a motor contained in the housing, and a switch arranged on the housing for controlling the motor. When the auto hammer is used between two surfaces perpendicular to each other with its opposite sides of the upper portion of the housing abutting against the two surfaces respectively, the distance from the central axis of the striking rod to the intersecting line of the two surfaces is between 10 mm and 40 mm, preferably 28 mm. This distance is arranged very small for allowing the auto hammer to be used closer to the intersecting line of the two surfaces.

The distance between the end surface of the striking end of the striking rod and the center of the impact wheel of the auto hammer is between 40 mm and 100 mm, preferably 70 mm. This distance is arranged very small, in favor of the auto hammer being used in narrower spaces.

The distance between the opposite sides of the upper portion of the housing of the auto hammer is between 50 mm to 80 mm, preferably 66 mm. This distance is arranged very small, in favor of the auto hammer being used in narrower spaces.

BRIEF DESCRIPTION OF THE DRAWINGS

The detailed descriptions for this invention will be illustrated by preferred embodiments with reference to the following accompanying drawings, wherein.

Figures 6A, 6B:
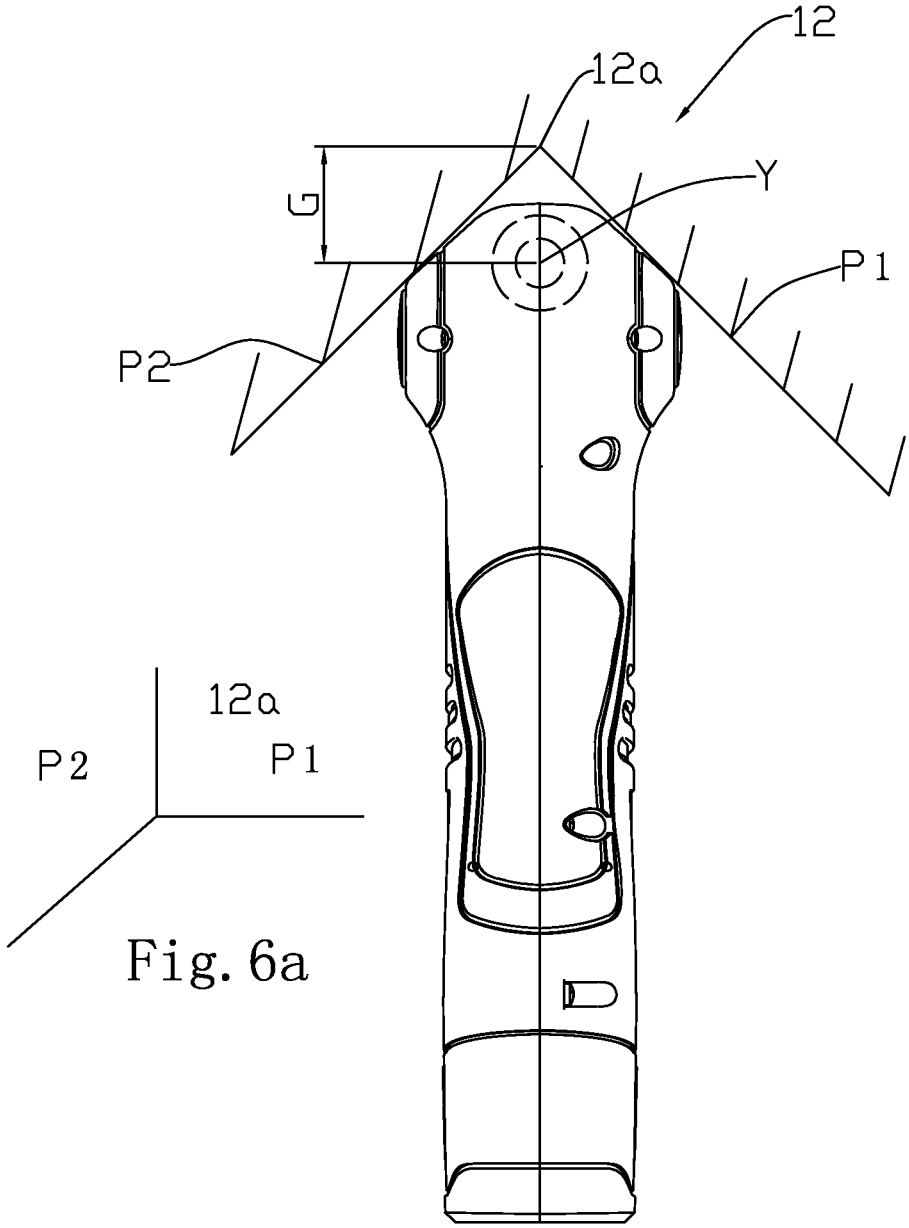

FIG. **6*a*** is a schematic view of two surfaces that are perpendicular with each other;

FIG. **6*b* is a plan view showing the auto hammer of the first embodiment adapted for use in the corner of the two surfaces being at a right angle with each other as in FIG. 6*a*;**

Figure 7:
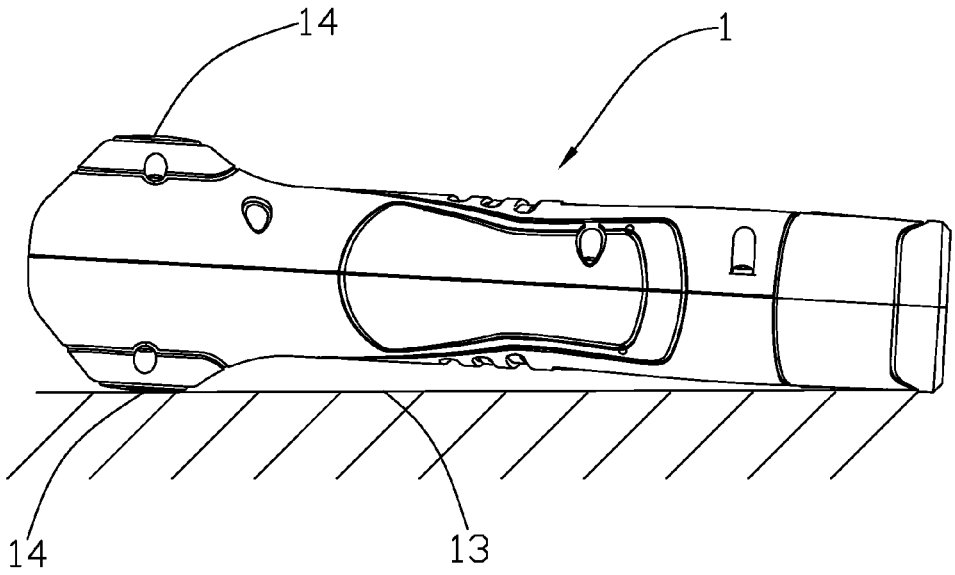
Figure 8:
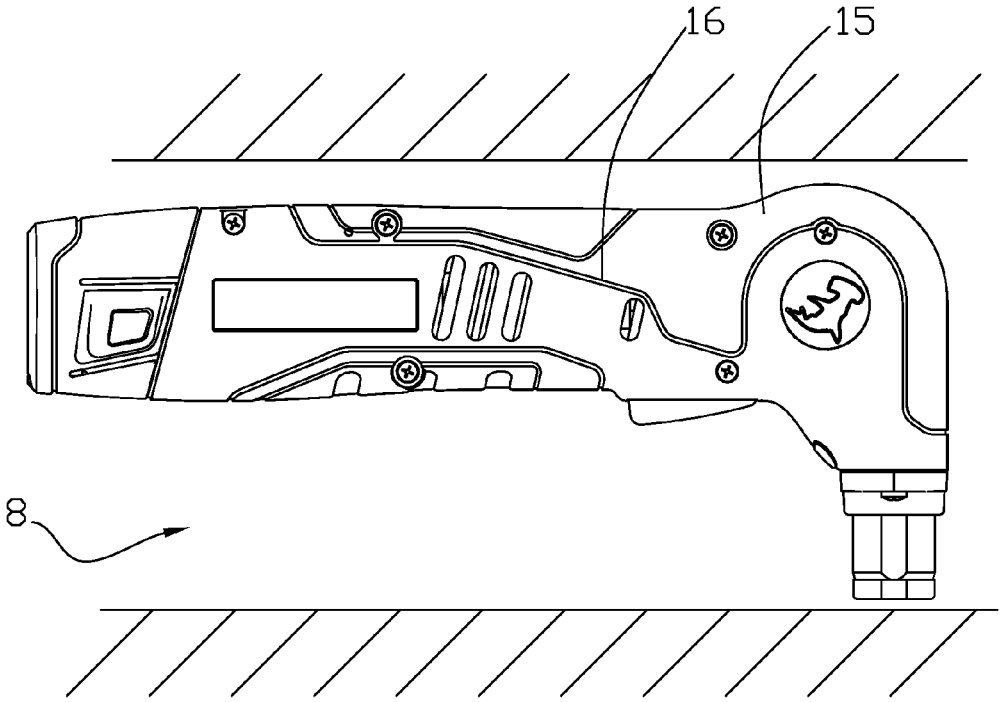
Figure 9:
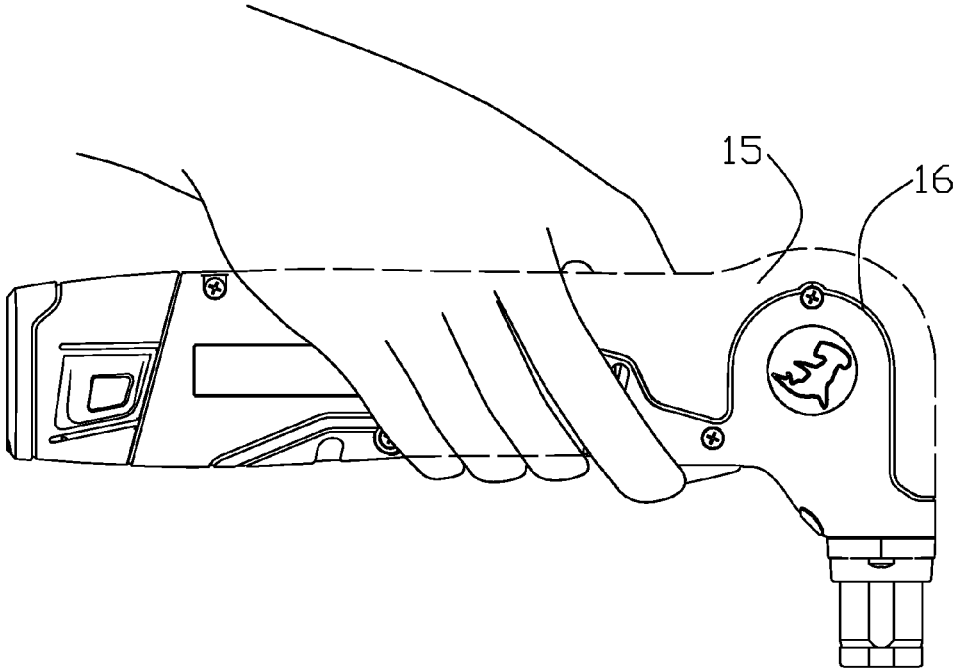
Figure 10:
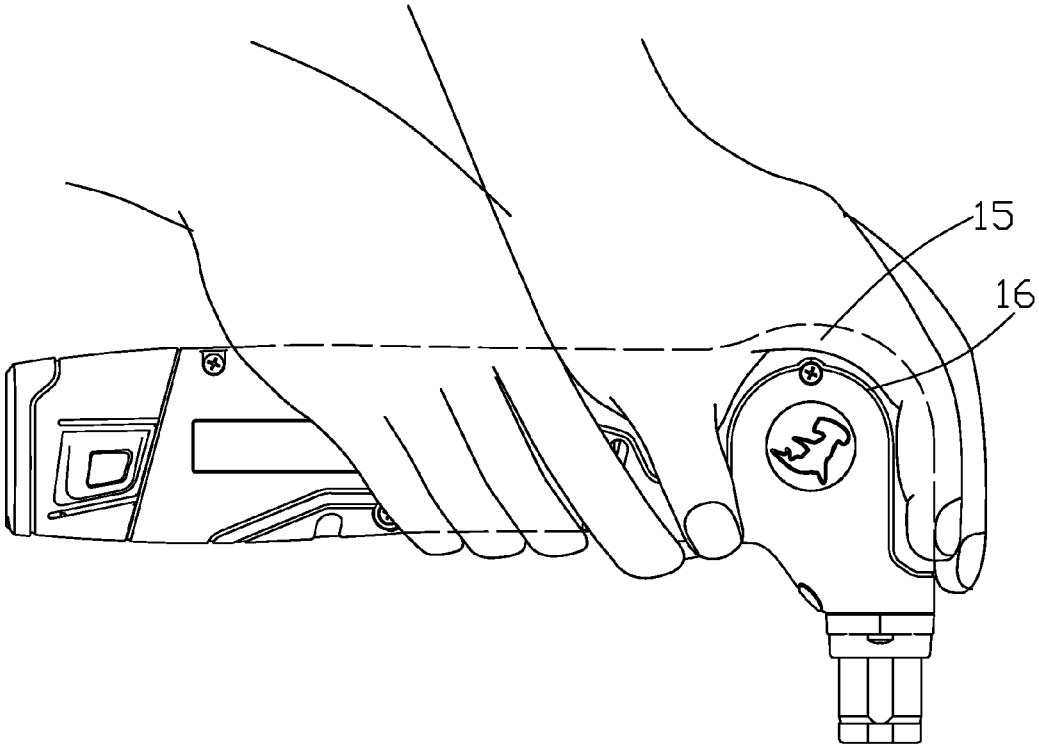
Figure 11:
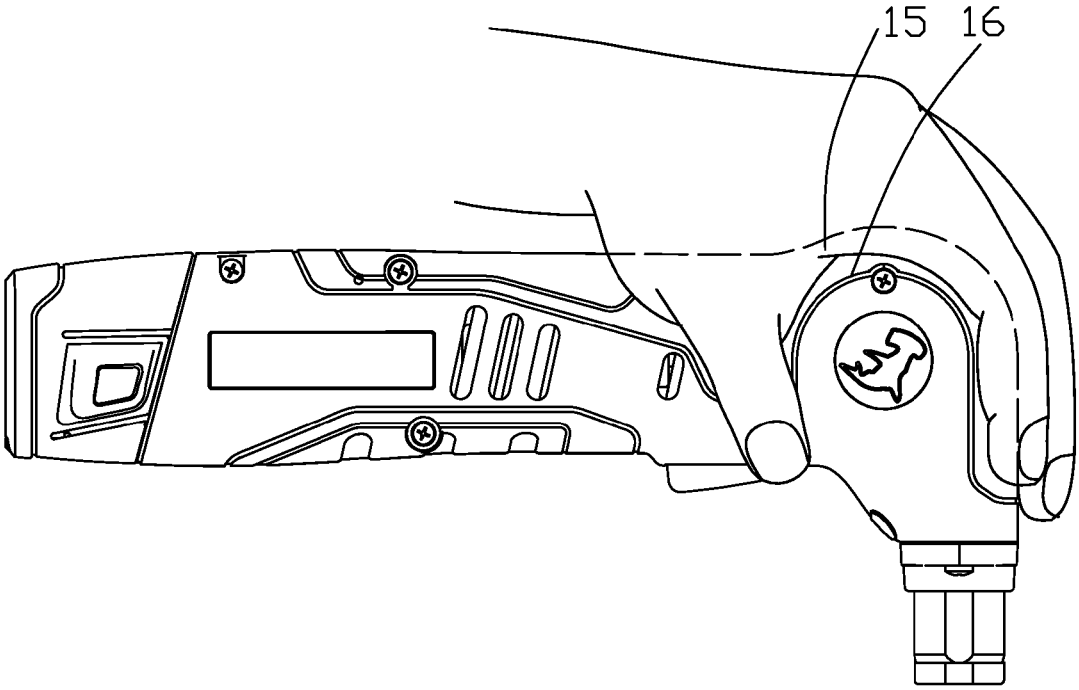
Figure 12:
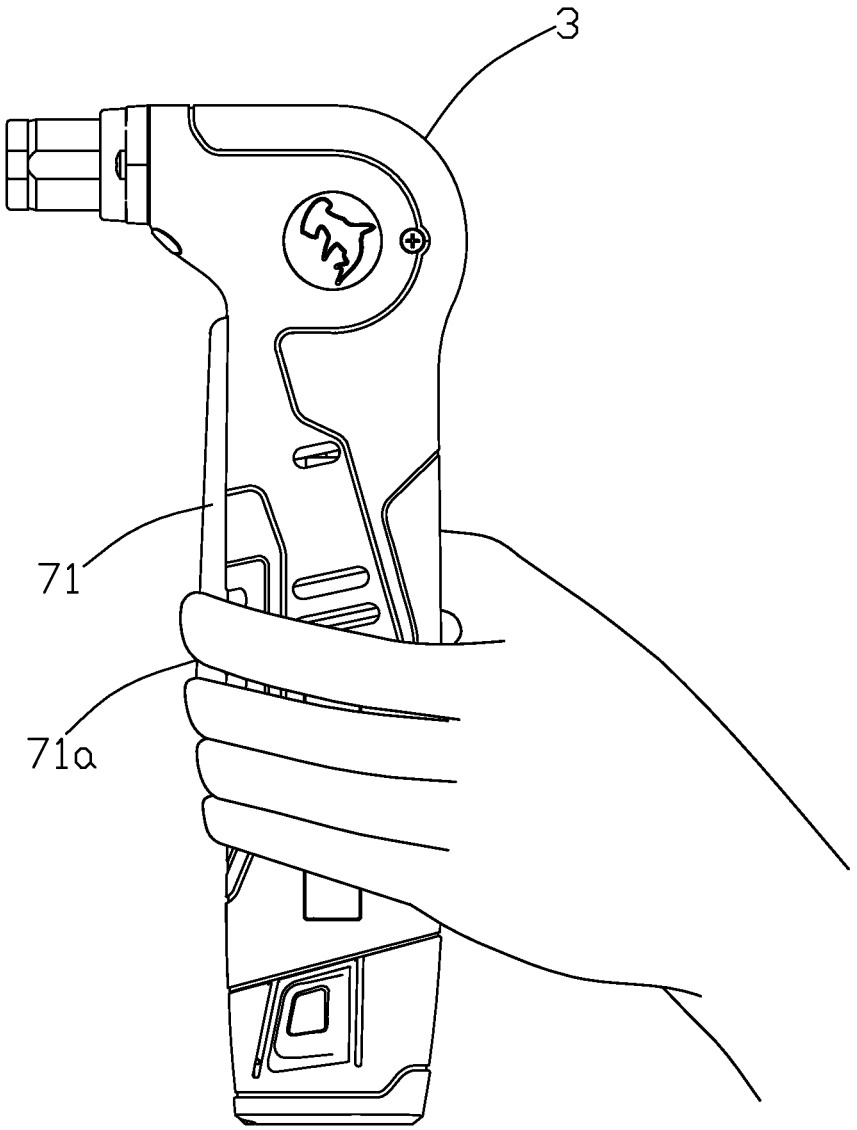
Figure 13:
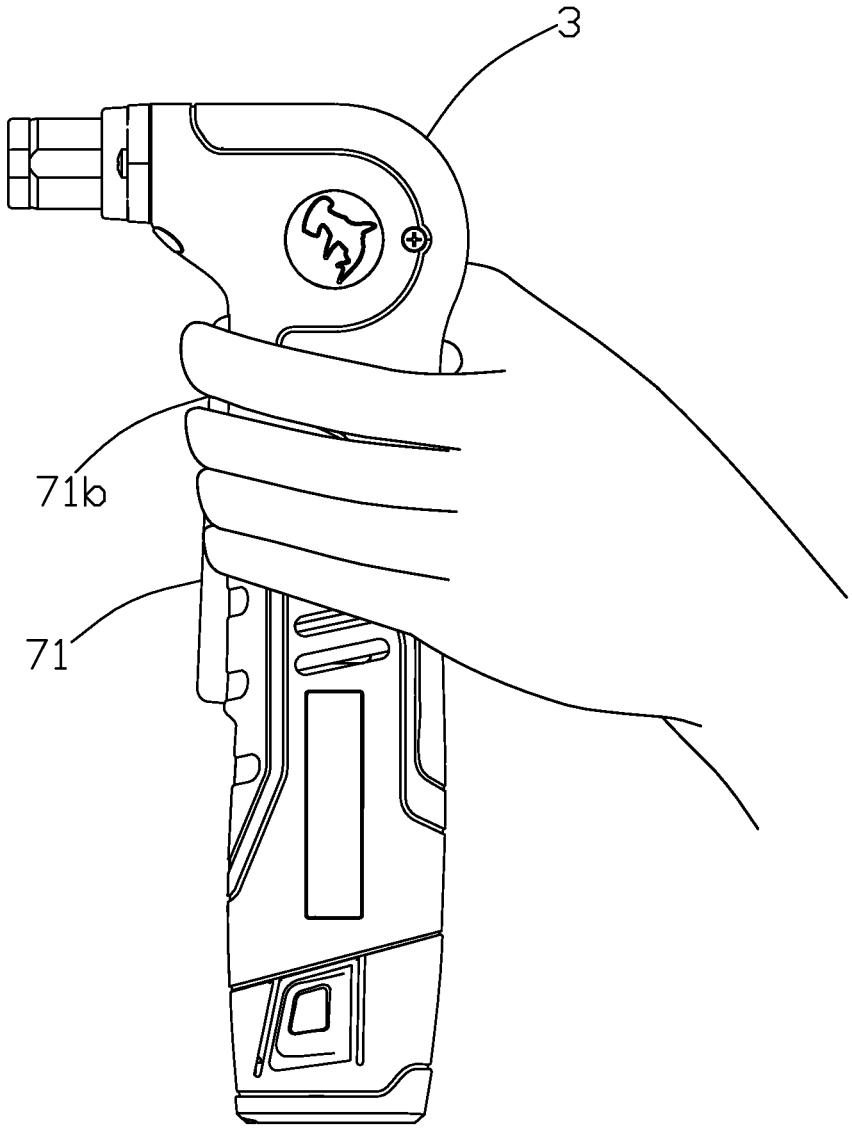
Figure 14:
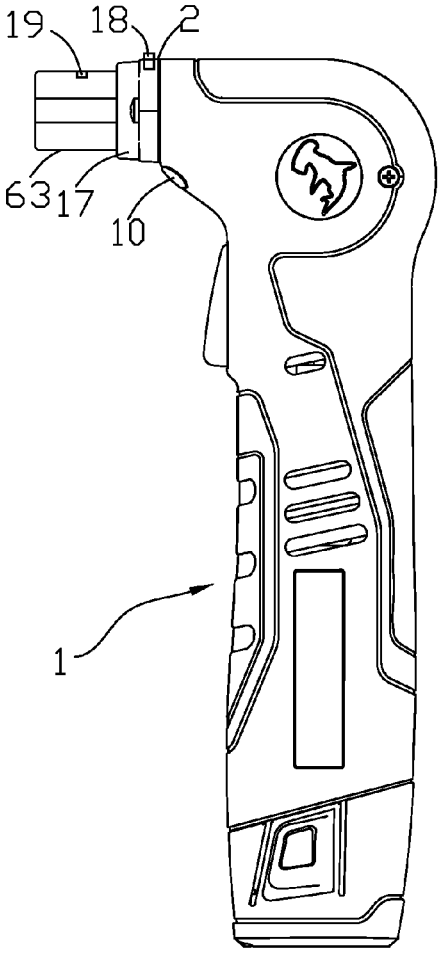
Figure 15:
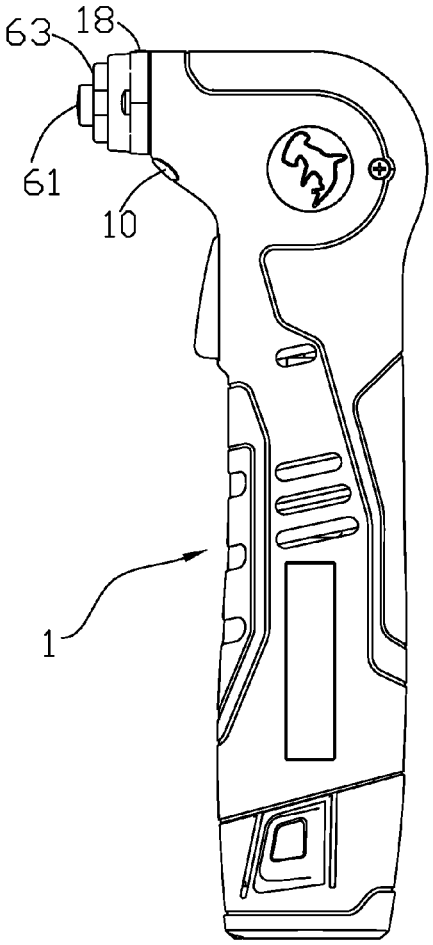
Figure 16:
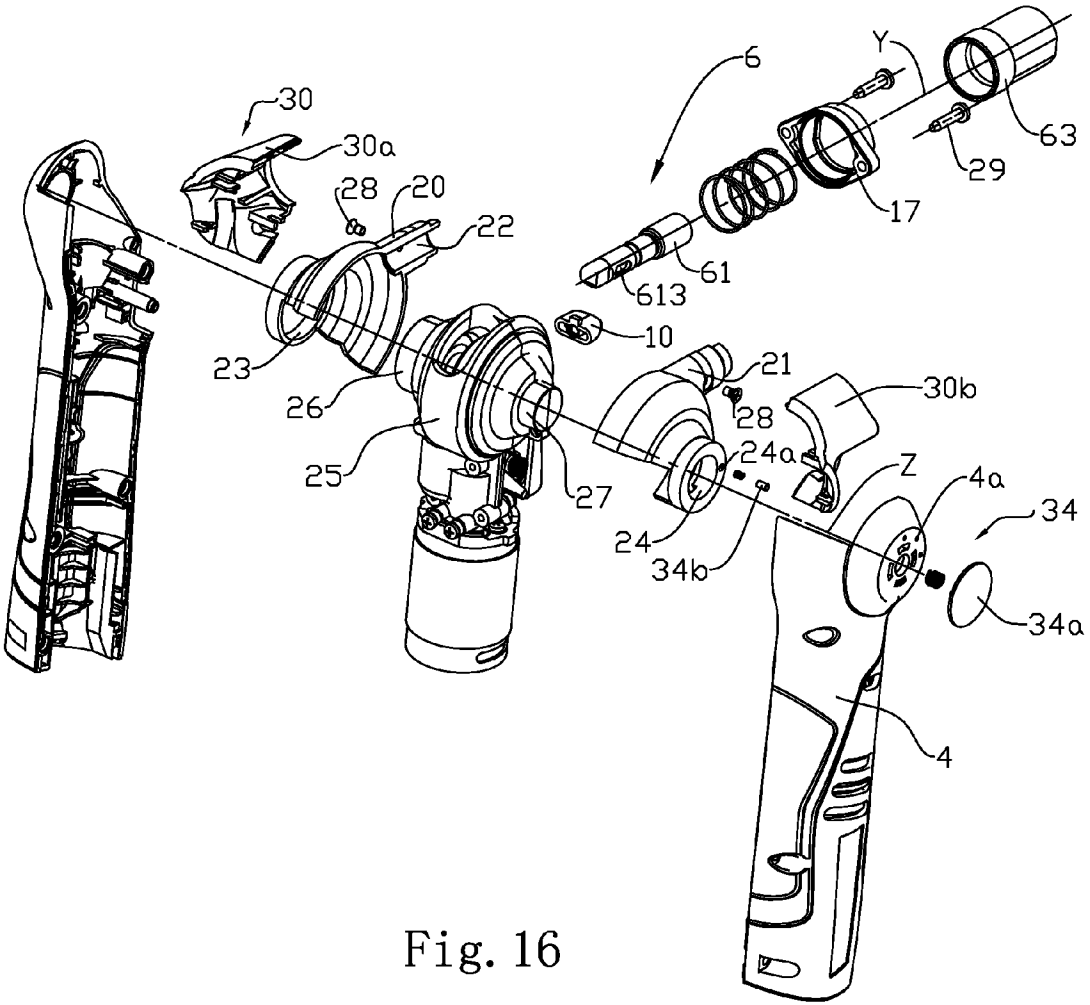
Figure 17:
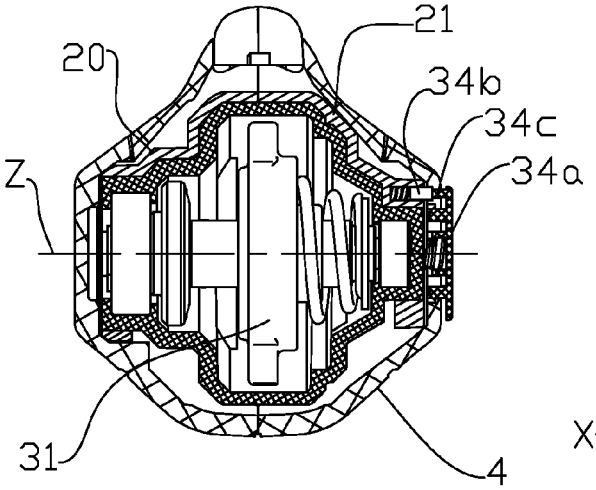
Figure 18:
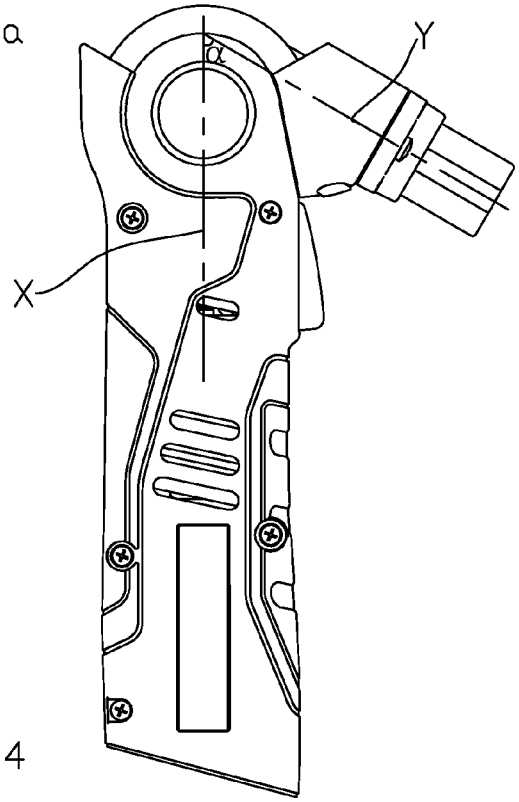
Figure 24:
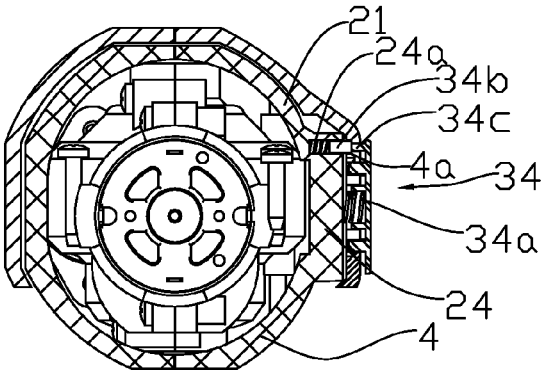
Figure 19:
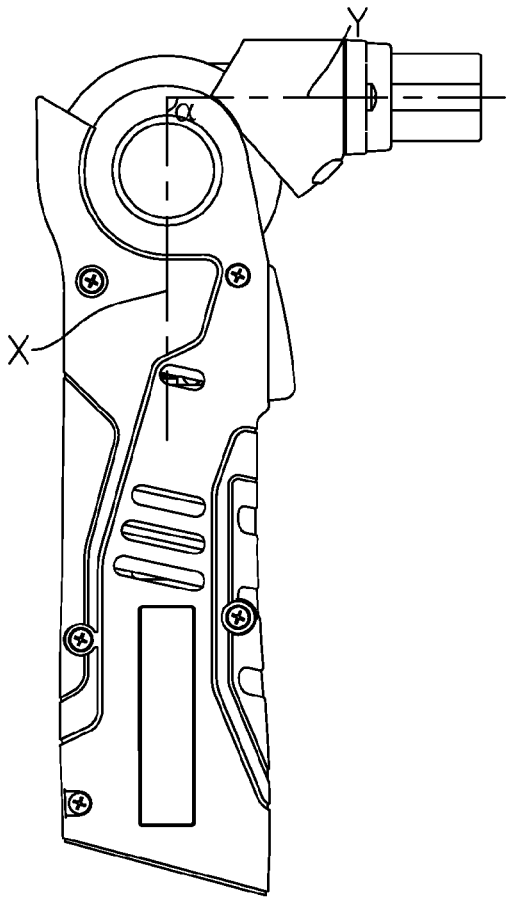
Figure 20:
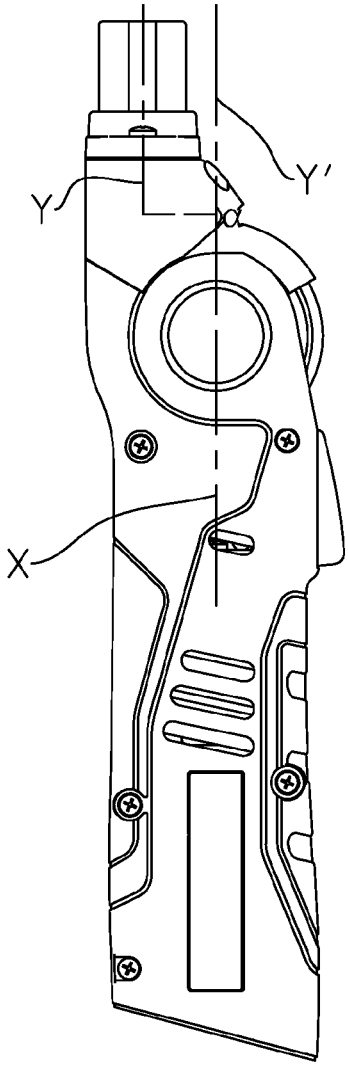
Figure 21:
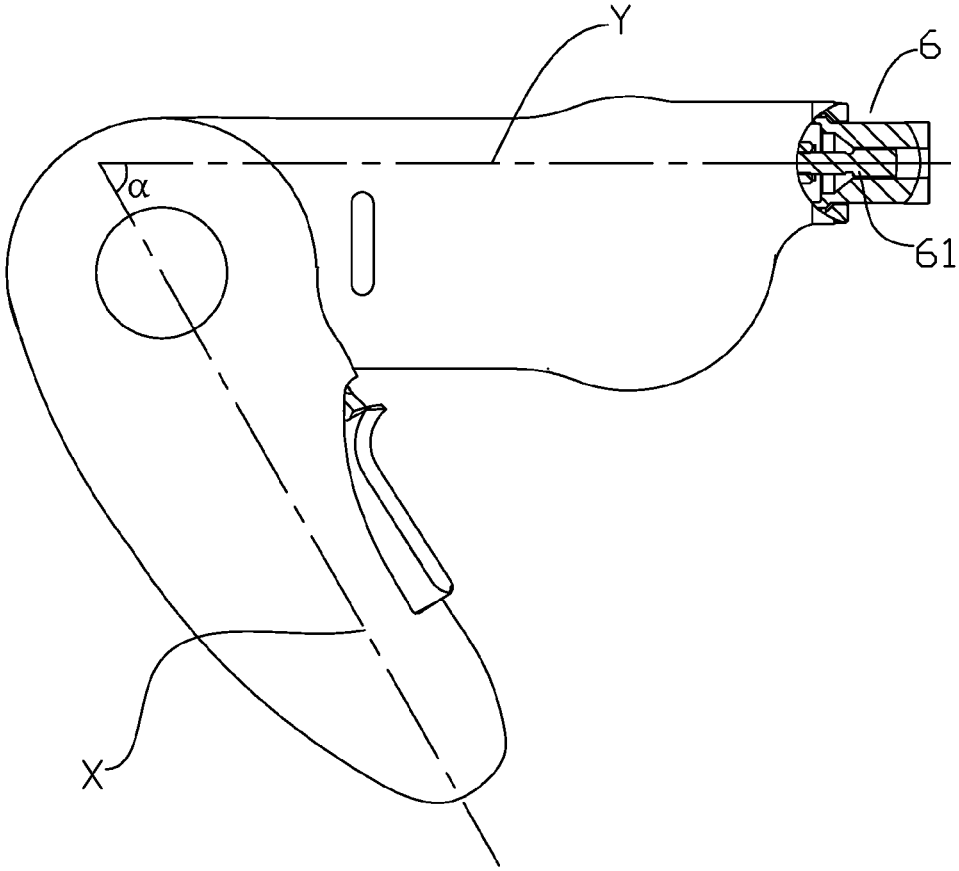
Figure 22:
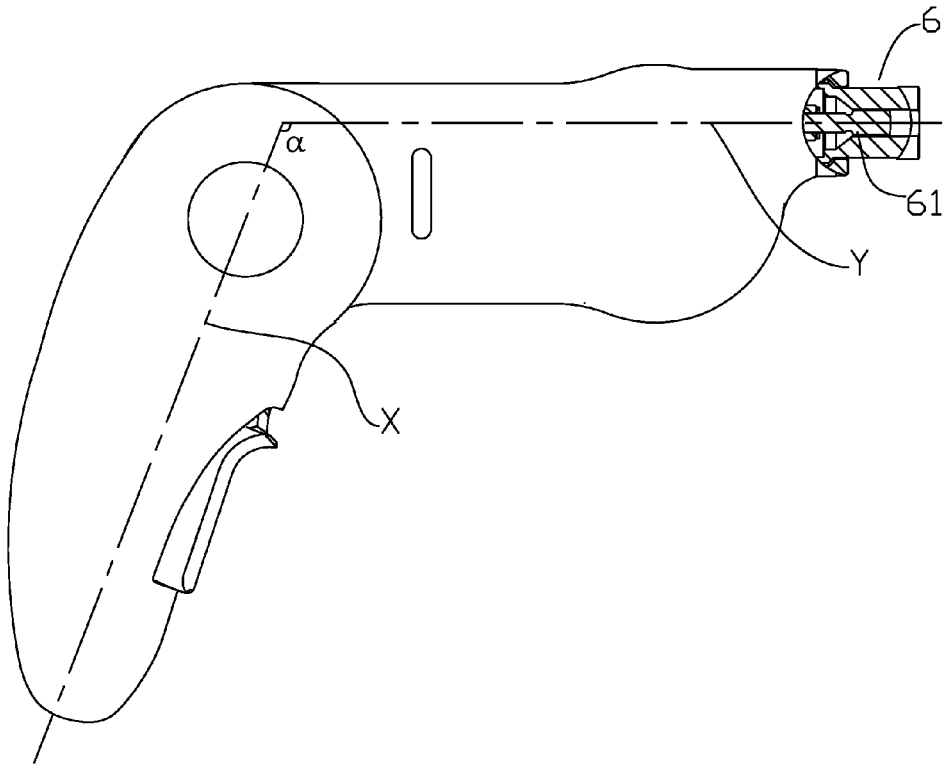
Figure 23:
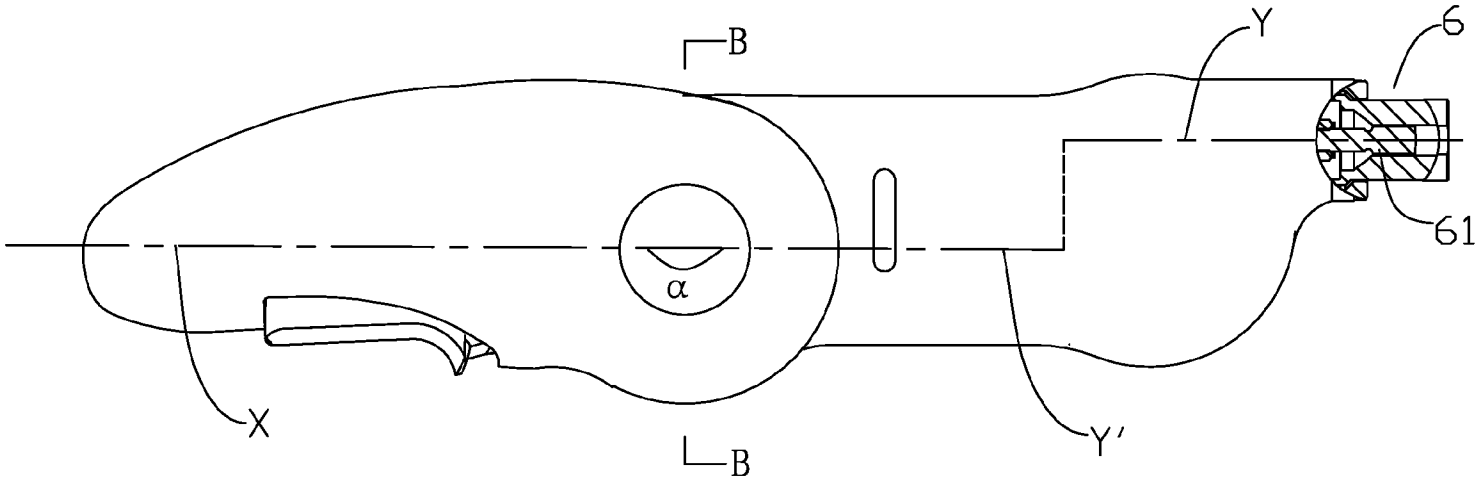
Figure 25:
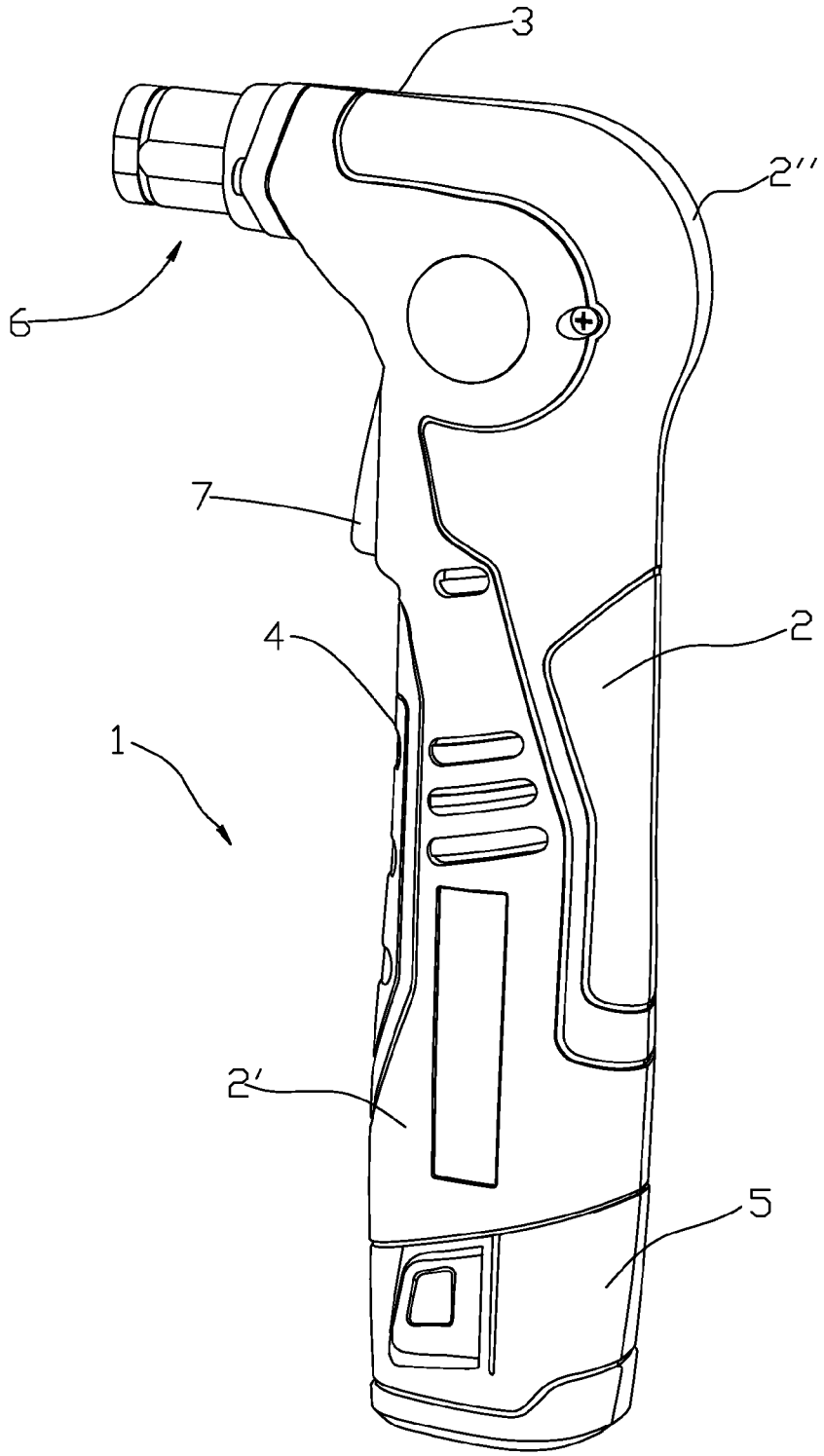
Figure 26:
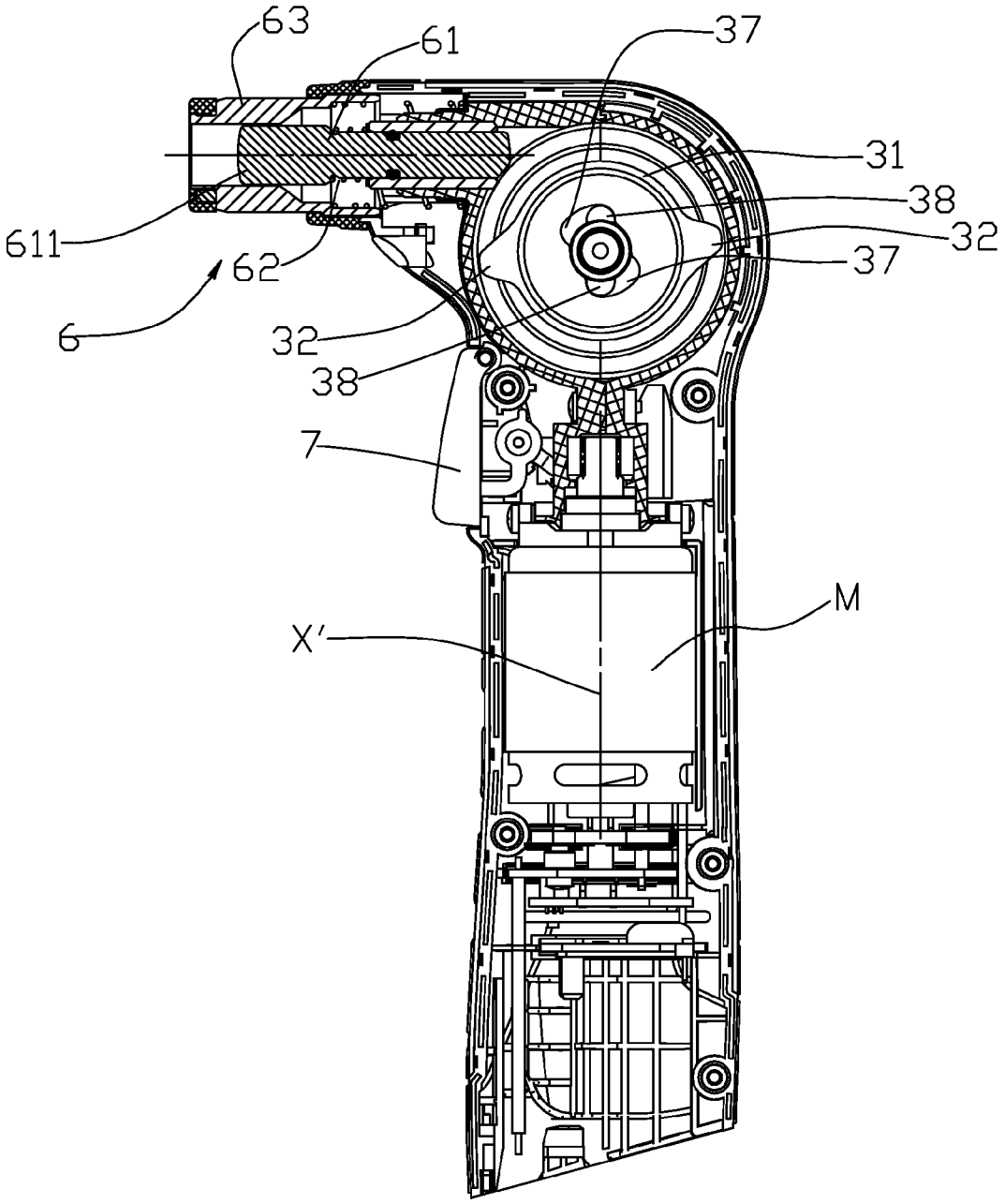
Figure 27:
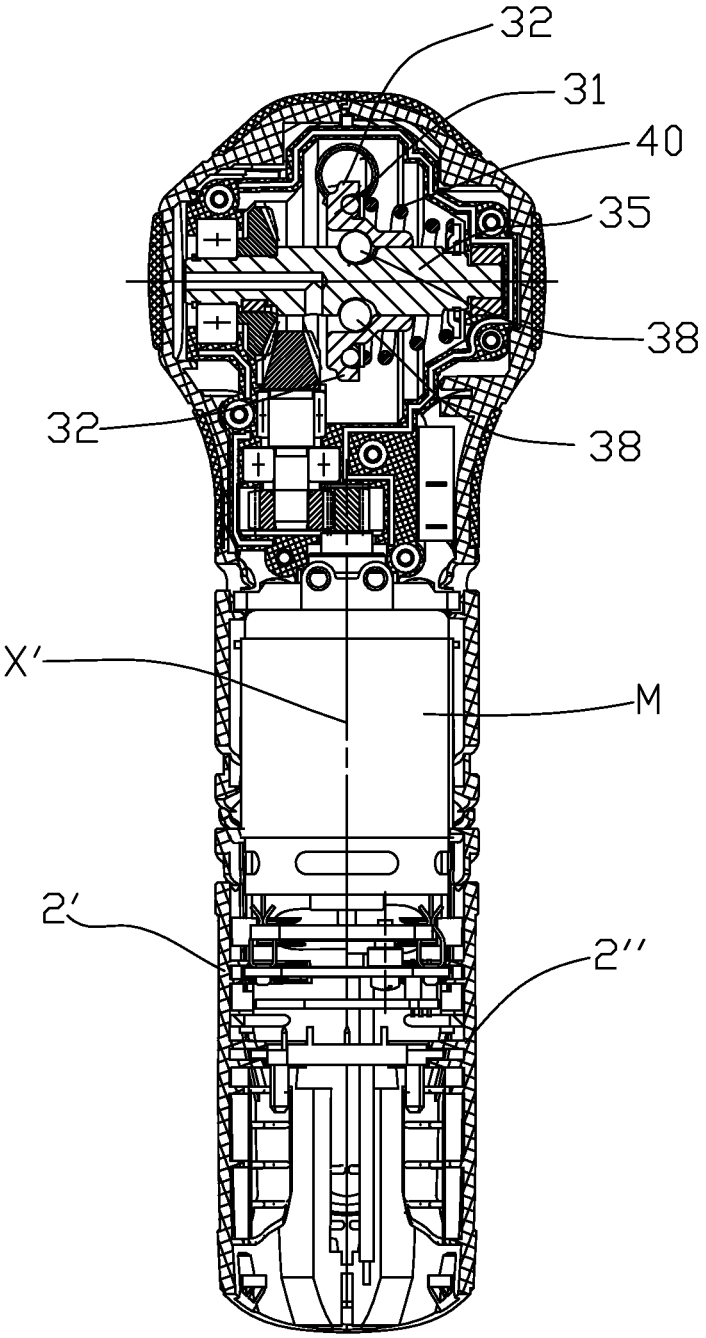
Figure 28:
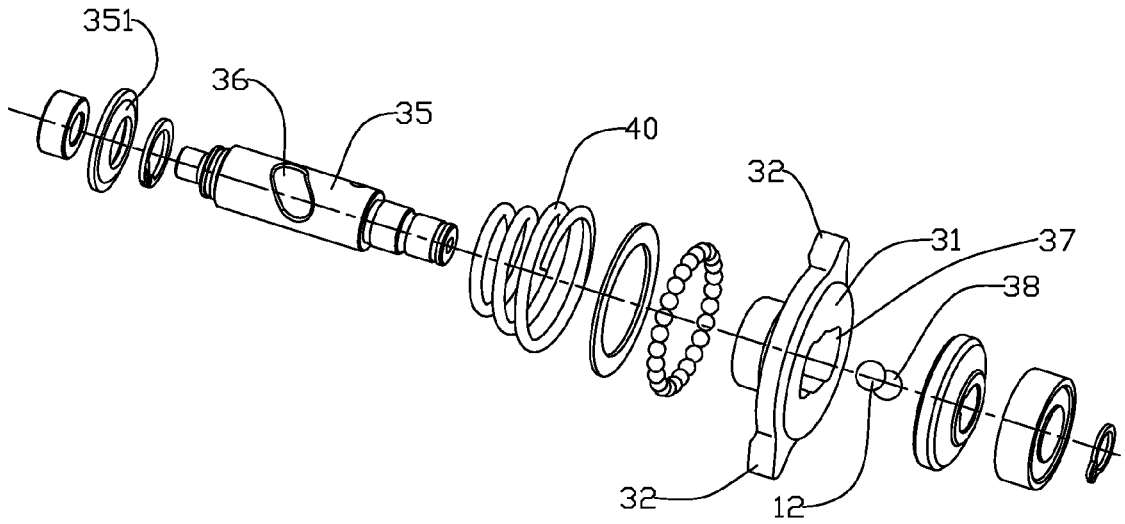
Figure 29:
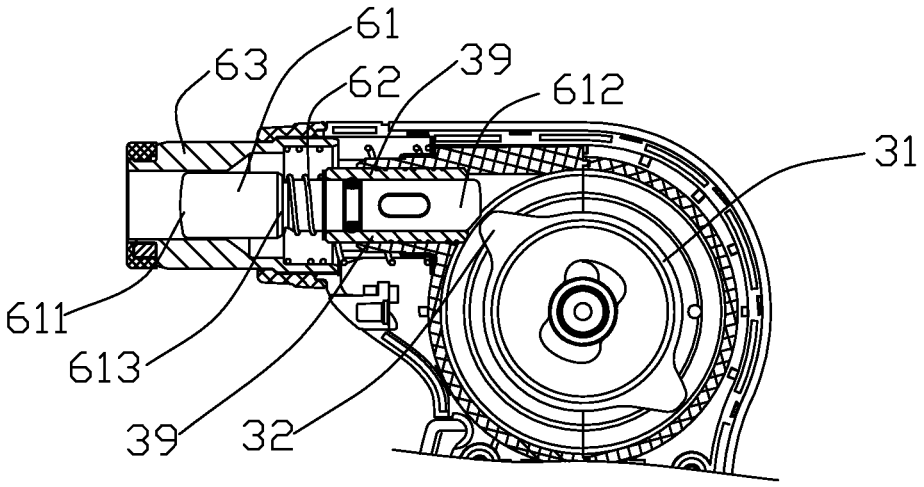
Figure 30:
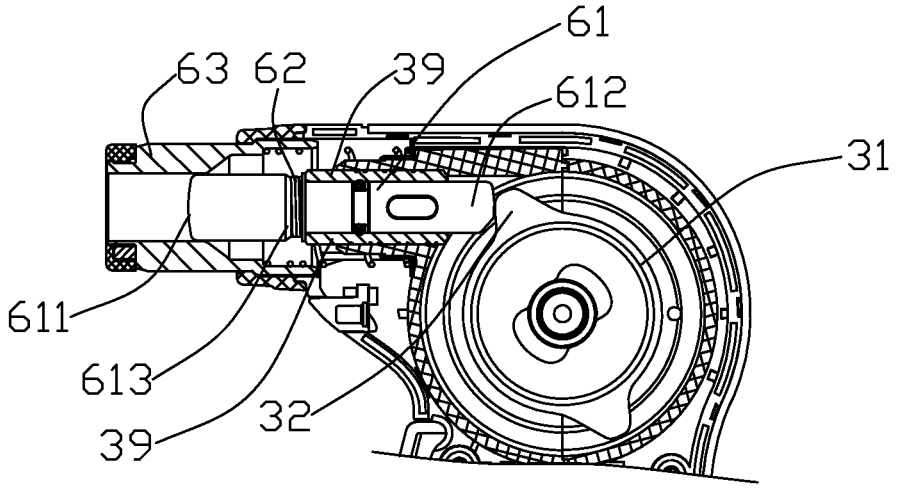

FIG. 7 is an illustrative view showing the auto hammer of the first embodiment adapted for being placed on a working board;

FIG. 8 is an illustrative view showing the auto hammer of the first embodiment adapted for use in another narrow space;

FIG. 9 is an illustrative view showing the auto hammer of the first embodiment adapted to be operated by a single hand;

FIG. 10 is an illustrative view showing the auto hammer of the first embodiment adapted to be operated by a pair of hands;

FIG. 11 is an illustrative view showing the shapes of the hand and the soft covering of the hammer;

FIG. 12 is an illustrative view showing the grasp position for an auto hammer of a second embodiment;

FIG. 13 is an illustrative view showing another grasp position for the auto hammer of the second embodiment;

FIG. 14 is a schematic view of an auto hammer of a third embodiment, wherein the receiving cavity thereof is lockable;

FIG. 15 is a schematic view of the auto hammer of FIG. 14, with the receiving cavity thereof being shown in a locked state;

FIG. 16 is an exploded view of an auto hammer of a fourth embodiment, wherein the striking device thereof is rotatable;

FIG. 17 is a cross-sectional view of the locking mechanism of the fourth embodiment;

FIGS. 18-20 are schematic views of the auto hammer of the fourth embodiment, with the angle α between the central axis of the striking rod and the central axis of the grip being shown in 60°, 90° and 180° respectively;

FIGS. 21-23 are schematic views of an auto hammer of a fifth embodiment, with the angle α between the central axis of the striking rod and the central axis of the grip being shown in 60°, 110° and 180° respectively;

FIG. 24 is a sectional view taken along axis B-B in FIG. 23;

FIG. 25 is a perspective view of the auto hammer of the first embodiment;

FIG. 26 is a sectional view of the auto hammer as shown in FIG. 25 taken along the combination surface of the two halves of housing, wherein the battery pack of the device is removed for clarity;

FIG. 27 is a sectional view of the auto hammer as shown in FIG. 25 taken along a direction perpendicular to the combination surface of the two halves of the housing, wherein the battery pack of the device is removed for clarity;

FIG. 28 is a partial exploded view of the transmission device of the auto hammer in FIG. 25;

FIG. 29 is a sectional view of the striking device of the auto hammer in FIG. 25, with the striking device being shown in an initial position;

FIG. 30 is a sectional view of the striking device of the auto hammer in FIG. 25, with the striking device being shown in a stricken position.

DETAILED DESCRIPTION

As shown in FIGS. 25 and 26, an auto hammer 1 according to an illustrated embodiment comprises a striking device 6 and a housing 2 containing a motor M therein. The housing 2 is formed by joining two halves 2' and 2" in juxtaposition. A substantially vertical grip 4 is formed by a main portion of the housing 2. An upper portion of the housing 2 includes a head assembly 3 comprising a transmission mechanism and a striking device 6 formed by projecting forwardly.

In this embodiment, the auto hammer 1 includes a battery pack 5 for supplying electricity to the motor M. However, the auto hammer need not be restricted to the use of a DC power supply and may be equally powered by a source of AC power. A switch 7 is arranged on the housing 2 for controlling the motor M. The striking device 6 includes a striking rod 61 mounted therein by a spring. The striking rod 61 is disposed substantially horizontal and is moved linearly in a reciprocating manner within the striking device 6. During operation, the striking end 611 of the striking rod 61 is moved to act with its end surface on components such as fastening pieces like nails and tenons or objects like bricks, etc. The striking device 6 also contains a receiving cavity 63 therein which is designed to be a retractable structure, which may contact with the surface of the objects to be processed. Additionally, the receiving cavity 63 has an inner diameter larger than that of normal fastening pieces. As a result, fastening pieces of all kinds of dimension may be placed into the receiving cavity 63.

As shown in FIGS. 27-30, a rotation-linear movement transmission mechanism is arranged in the housing 2 for converting rotating motions of the motor M into impact motions of the striking rod 61. The motor M is mounted vertically in the housing 2 with an upward motor shaft X' connected with a multi-stage gear transmission mechanism including a bevel gear. In this way, the rotation power of the motor 2 is transmitted to the rotating shaft 35 which is mounted in the upper portion of the housing 2 by the bearings on both ends. A pair of inclined slots 36 is formed on the rotating shaft 35, each of which is "V" shaped and which opens backwardly. An impact wheel 31 is mounted on the rotating shaft 35. The impact wheel 31 is substantially a hollowed cylinder comprising a pair of arcuate guiding slots 37 which are formed on its inner wall and opposite to the two inclined slots 36 respectively. Each of the guiding slots 37 is opened with its arcuate portion being oriented in a direction opposite to that of the corresponding "V" shaped inclined slot 36. The inclined slots 36 and the guiding slots 37 both have a semicircle bottom. A pair of steel balls 38 is arranged movably in two chambers formed by the corresponding inclined slot 36 and guiding slot 37. When the inclined slots 9 are moved with the rotating shaft 35 relative to the guiding slots 37, the chambers formed thereby are moved with a result that the steel balls 38 can be moved along with the chambers. The impact wheel 31 can thus be driven to rotate through the steel balls 38 within the inclined slots 36 when the rotating shaft 35 is rotated. A pair of projections 32, which are extended along the diameter direction of the rotating wheel 38, is provided on the periphery of the rotating wheel. When the switch 7 is triggered, the motor M is actuated and drives the rotating shaft 35 to rotate through a multi-stage gear transmission mechanism. As a result, the rotating shaft 35 then drives the impact wheel 31 to rotate therewith via the steel balls 38.

As shown in FIGS. 29 and 30, the striking rod 61 of the striking device 6 of the auto hammer 1 is inserted into a shaft sleeve portion 39 which is formed integrally with a gear housing. A restoring spring 62 is mounted by encircling the striking rod 61 in such a manner that one end of the spring 62 bears against a shoulder 613 of the striking rod 61, and the other end of the spring 62 bears against the end surface of the shaft sleeve portion 39. The restoring spring 62 exerts a spring force toward the outside of the housing onto the striking rod 61, along the longitudinal direction of the striking rod 61. When there is no external force acting on the striking rod 61, the stricken end 612 of the striking rod 61 is located at an initial position where it is not contactable with the projections 32 of the impact wheel 31 due to the spring force of the spring 62, as shown in FIG. 29. In this case, the spring 62 exhibits a first elastic state, and the stricken end 612 of the striking rod 61 is located out of the circular motion track of the projections 32. When there is an external force acting on the striking rod 61, e.g., when a fastening piece needs to be striken into a solid object, the striking rod 61 receives a larger force which overcomes the spring force of the spring 62 and urges the striking rod 61 to move toward the impact wheel 31. When the striking rod 61 reaches the position shown in FIG. 30, the spring 62 exhibits a second elastic state. In this state, the striking rod 61 is located at a stricken position where it is contactable with the projections 32 of the impact wheel and its stricken end 612 is in the circular motion track of the projections 32. As a result, there is one position in the circular motion track of the projections 32 where the projection 32 can contact with the stricken end 612 of the striking rod 61.

The restoring spring 62 mentioned above could be formed as a compression spring or a coil spring. However, it is easily conceivable for those skilled in the art that other elastic members or biasing members producing attraction forces or exclusion forces, such as magnetic members, may be used to replace the spring 62.

As shown in FIG. 28, an energy storing spring 40 is mounted between the impact wheel 31 and the rotating shaft 35 in manner that one end of the energy storing spring 40 abuts to the shoulder 351 of the rotating shaft 35 and the other end of the energy storing spring 40 abuts to a side surface of the impact wheel 31. Under an axial biasing force of the energy storing spring 40 acting upon the impact wheel 31 along the axial direction of the rotating shaft 35, the impact wheel 31 is located at a first axial position relative to the rotating shaft 35. In the first axial position, the impact wheel 31 rotates circumferentially by means of the rotating shaft 35 and the steel balls 38. If the striking rod 61 is now located at the stricken position as shown in FIG. 30, when the impact wheel 31 is rotated to a position where the projections 32 contact the striking rod 61, and the striking rod 61 encounters a larger resistance that is difficult to be overcome provisionally, the impact wheel 31 is temporarily stopped from rotating by the striking rod 61, so that the impact wheel 31, under the cooperation of the steel balls 38, the guiding slots 37 and the inclined slots 36, overcomes the axial force of the spring 40, compresses the energy storing spring 40 and moves from the first axial position to a second axial position relative to the rotating shaft 35. At this second axial position, the projections 32 of the impact wheel 31 depart from the striking rod 61 and the braking is released. In this case, the energy storing spring 40 starts to release the elastic potential energy thereof. By the rebound force of the energy storing spring 40, the impact wheel 31 is pressed back to its first axial position quickly, and is moved at a higher speed than that of the rotating shaft 35 under the cooperation of the inclined slots 36, the guiding slots 37 and the steel balls 38. As a result, the stricken end 612 of the striking rod 61 is impacted by the projections 32 on the impact wheel 31 to move at a high speed in a linear direction away from the projections 32 and the striking rod 61 strikes the head of the nail quickly. After the first striking action is finished, the striking rod 61 is pressed back to its initial position as shown in FIG. 29 under the rebound force of the restoring spring 42. When the impact wheel 31 is continuously driven to rotate to be stopped by the striking rod 61, it enters into succeeding cycles, which will be achieved in the same manner.

Figure 1:
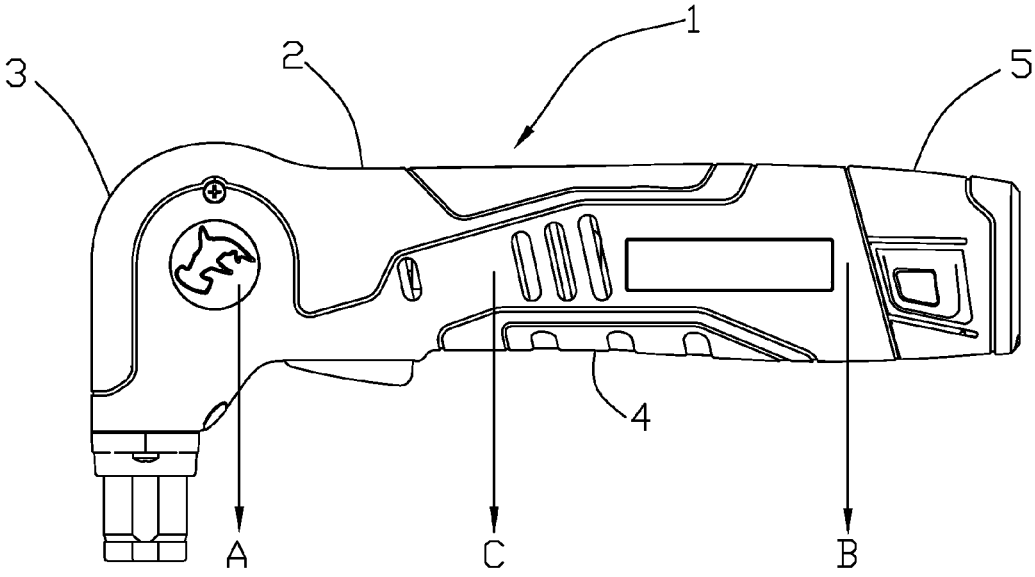
FIG. 1 is a profile view of an auto hammer constructed according to a first embodiment, with the auto hammer being positioned transversely.

FIG. 1-11 show a profile view of the auto hammer of the first embodiment according to this invention, which is in constructed to provide preferred ergonomics. An auto hammer of low effort, easy operation and comfortable grip is provided to satisfy the ergonomics. As shown in FIG. 1, the head assembly 3 is arranged on the left end of the housing 2 and the battery pack 5 is arranged on the right end of the housing 2. The weight constituting the auto hammer 1 includes the head assembly 3, the motor (as shown in FIG. 26) and the battery pack 5. The gravity center of the head assembly 3 lies at point A in FIG. 1, the gravity center of the motor lies at the grip 4, and the gravity center of the battery pack lies at point B, so that the gravity center of the auto hammer as a whole lies at point C. The head assembly 3 and the battery pack 5 are respectively disposed at the two ends of the housing 2, so that their gravity centers A and B are located at the opposite ends of the grip 4, respectively. As a result, the gravity center C of the tool 1 is located at the hand-holding position as shown in FIG. 9 when the tool 1 is operated by hand. With such configuration, the user feels more comfortable during operation. It could be understood that the whole gravity center may also be located at the hand-holding position of the tool by arranging the head assembly and the motor respectively at the two ends of the housing when other ways of power supply, such as alternating current, are adopted.

Figure 3:
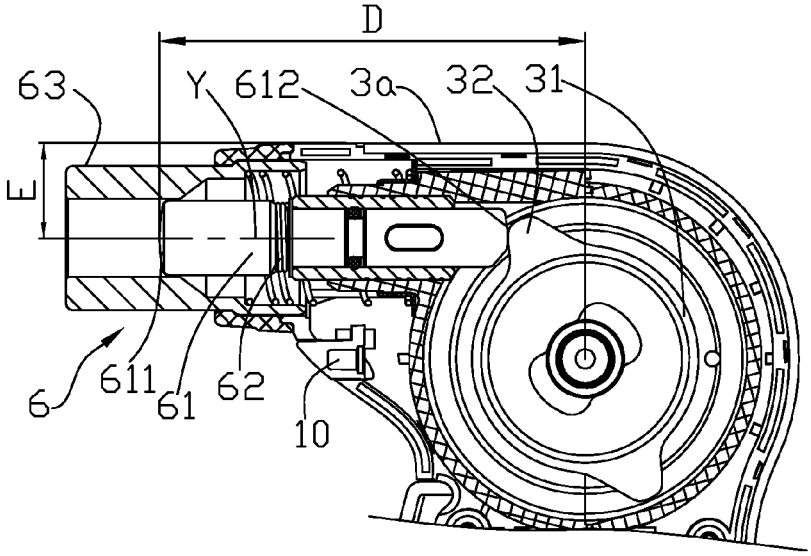
FIG. 3 is a cross-sectional view of a head assembly of the auto hammer along the sectional line A-A in FIG. 2.
Figure 2:
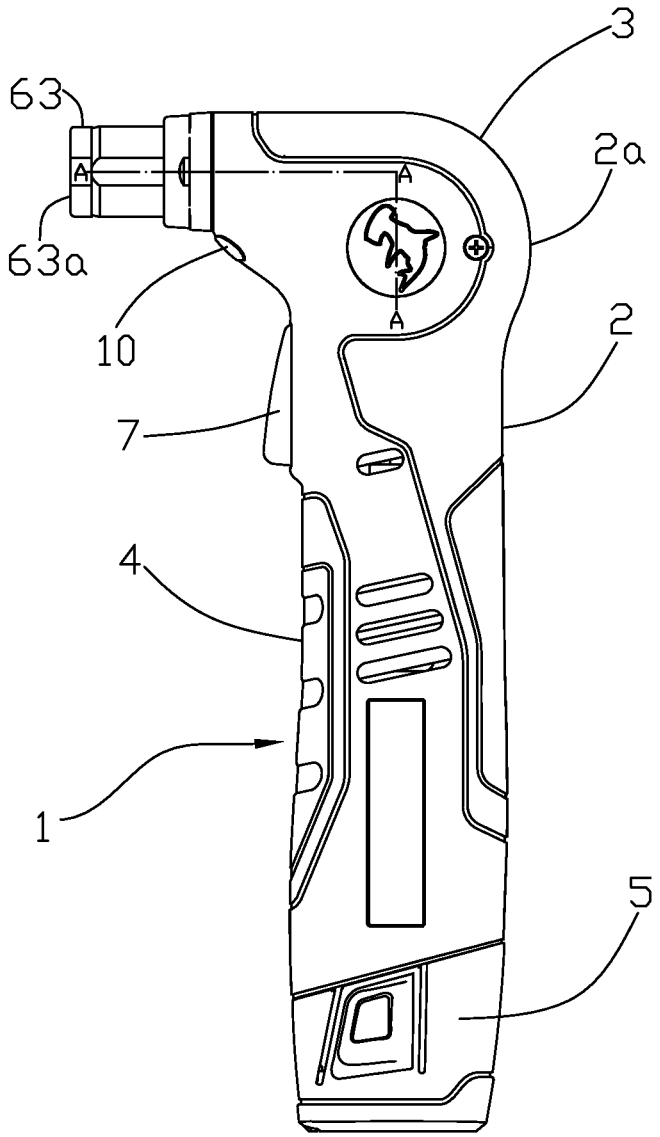
FIG. 2 is a profile view of the auto hammer of the first embodiment, with the auto hammer being positioned vertically.
Figure 4:
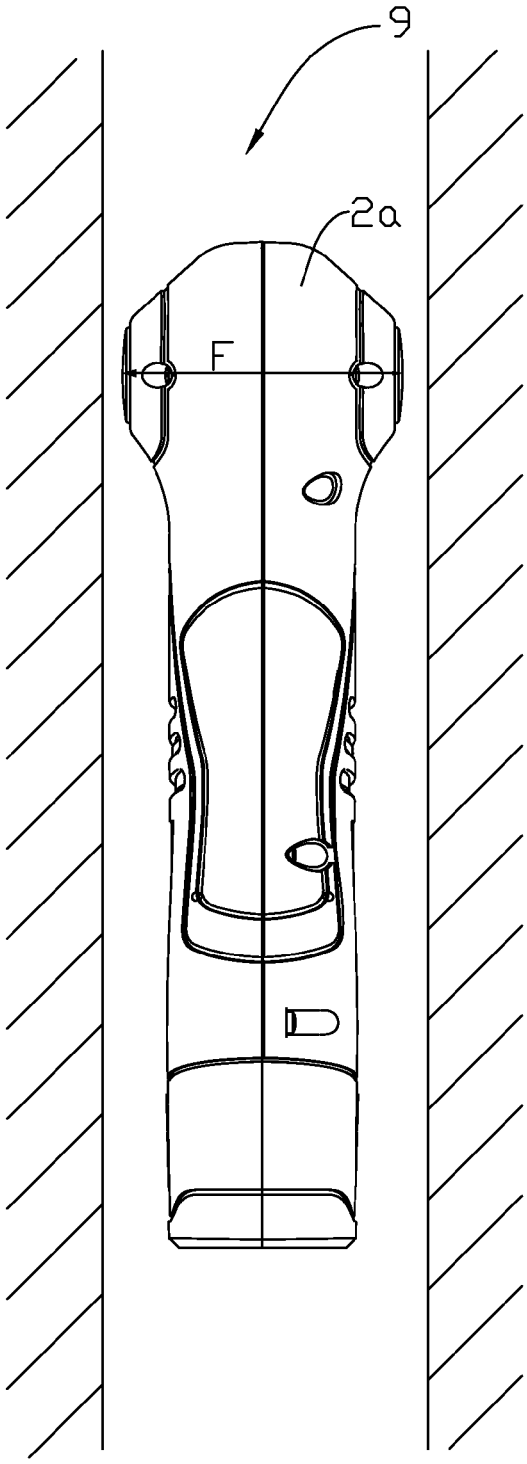
FIG. 4 is an illustrative view showing the auto hammer of the first embodiment adapted for use in a narrow space.

FIGS. 2-4 are dimensional views of the head assembly of the first embodiment. In this embodiment, fastening pieces, such as nails, screws, pins, staples and the like can be received in the receiving cavity 63. The housing 2 includes an upper portion 2*a*. In favor of the tool 1 being used in a narrow space 8 which is restricted in the horizontal direction as shown in FIG. 8, the distance D from the end surface of the striking end 611 of the striking rod 61 to the center of the impact wheel 31, which is usually between 40 mm-100 mm, is preferably 70 mm. For use of the tool 1 in a narrow space 9 that is restricted in the vertical direction as shown in FIG. 4, the distance F between the opposite sides of the upper portion of the housing, which is usually between 50 mm-80 mm, is preferably arranged at 66 mm. It will be understood that, in favor of the tool 1 being used in a narrow space (not shown) that is restricted both in the horizontal direction as shown in FIG. 8 and in the vertical direction as shown in FIG. 4, the distances D and F, which are usually between 40 mm-100 mm and 50 mm-80 mm respectively, are preferably arranged at 70 mm and 66 mm respectively at the same time.

As shown in FIG. 2, a lighting source 10 constructed as a LED is arranged at the left portion of the housing 2 under the receiving cavity 63. When the switch 7 is pressed, the lighting source 10 will work with the tool 1 to light the receiving cavity 63 and the surface of the objects to be processed. With such configuration, the fastening pieces can be nailed into the working piece to be processed reliably and accurately even in a low light condition. In spite of the influence of the vibrations during operation, the lighting source 10 will still achieve a good lighting effect if the lighting source is a LED, in particular a LED of high energy. However, the lighting source may also be replaced by other lighting device such as incandescence lamp. In good light conditions, an additional separate switch (not shown) may also be arranged to control the lighting source 10, so as to increase the lifetime for the battery to be used.

Figure 5:
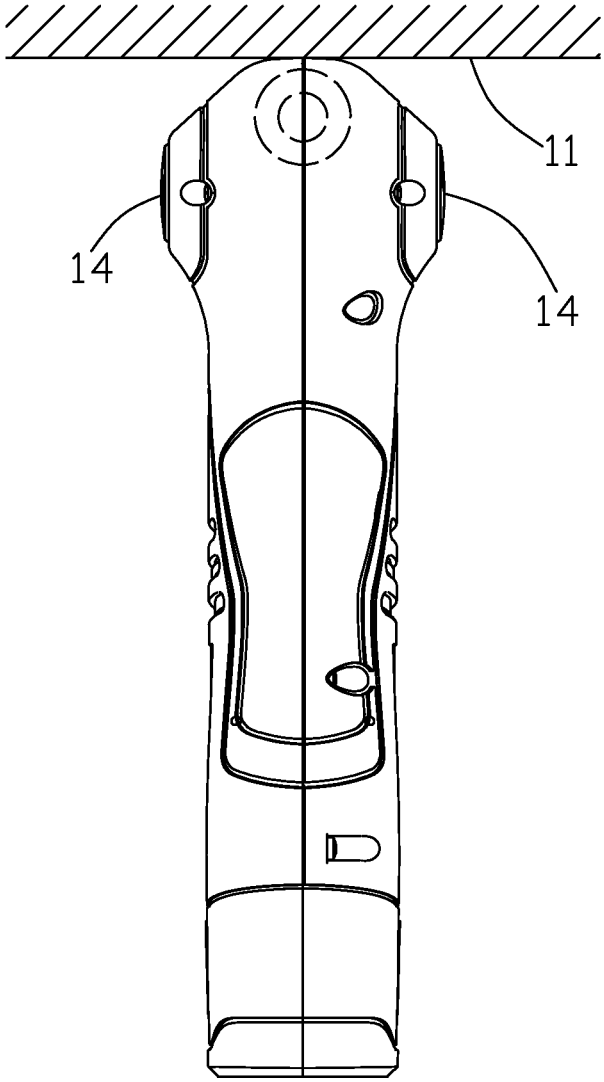
FIG. 5 is an illustrative view showing the auto hammer of the first embodiment adapted for use near a base wall.

In order to facilitate the tool 1 to be used near the base wall 11 shown in FIG. 5, the distance E between the central axis Y of the striking rod 61 and the top portion 3*a* of the head assembly, which is usually between 5 mm-26 mm, is preferably arranged at 10.7 mm. By such a configuration, the striking rod 61 is closer to the base wall 11 so that the fastening pieces are nailed near the base wall 11. In favor of the tool 1 being used in the area 12 between two surfaces that are perpendicular to each other as shown in FIGS. 6*a*, 6*b*, the distance G from the central axis of the striking rod to the intersecting line 12*a* of the two surfaces P1, P2, which is usually arranged between 10 mm-40 mm, is preferably 28 mm when the opposite sides of the upper portion of the housing of the tool 1 abut against the two surfaces. As a result, the tool 1 may be used closer to the intersecting line of these two surfaces.

FIG. 7 shows a schematic view of the housing, with a soft cover arranged on the opposite sides of the upper portion thereof. In this embodiment, in favor of the tool 1 being positioned on a work board 13, the housing 2 is preferably made from ABS material, with a soft cover 14 which is made from PVC or TPE material, being arranged on the opposite sides of the upper portion of the housing. Usually, the material on opposite sides of the upper portion of the housing is different from that of the remaining portion of the housing 2. When the tool is positioned transversely on the working board 13, the hardness of the soft cover 14 is lower than that of the material of the housing, so as to protect the tool 1 and the working board 13. When the tool 1 falls off from hands, the soft cover 14 may also protect the tool 1.

FIGS. 8-11 are schematic views of the head assembly with a soft cover arranged thereon. Preferably, in this embodiment, the tool 1 is arranged with a soft cover 15 made from TPE material on its head portion for convenient operation. The soft cover 15 is molded together with one half-housing, forming a PE line 16. Likewise, there is also a symmetrical PE line 16 (not shown) on the other half-housing symmetrical to said one half-housing. Usually, the material of the head portion of the tool 1 is different from that of remaining portion of the housing. As shown in FIGS. 9-11, the dashed lines show the portions with PE on the housing. When the pressure applied by single hand during operation isn't sufficient, a larger pressure may be provided by one hand gripping the soft cover of the grip and the other hand pressing the head portion. Therefore, the soft cover arranged in the head portion can enhance the comfortableness during operation. The hardness of the soft cover is less than that of the material of the housing and conforms to ergonomics in its shape, such that the fingers and the palm may just contact the soft cover 15 during operation.

FIGS. 12-13 are illustrative views showing the grip manners for the auto hammer according to a second embodiment, wherein similar components with the same effect and function in different embodiments are indicated by like numerals, which is similar hereinafter. As shown in FIG. 2, the switch 7 is small-sized, and is arranged in the grip portion 4 close to the head assembly 3. However, when the working conditions is restricted, such as when the head assembly 3 and the switch 7 enters into an narrow space where the hands can not reach to trigger the switch, it is desirable for a switch 71 of long dimension as shown in FIG. 12, so that the proximal end 71*a* of the long switch 71 can be operated by hand. Furthermore, with such switch of long dimension, the distal end 71*b* of the long switch 71 can also be operated by hand for other working conditions, such as the space under machines where the hands can not reach. By this configuration, there are at least two grip positions for a hand to meet different working conditions and improve the convenience of the tool.

FIGS. 14-15 are schematic views of an auto hammer of a third embodiment, wherein the receiving cavity thereof is lockable. Auto hammer 1 can be used to strike all kinds of objects. In some circumstances for frequent strike, a lot of physical labor will be consumed during operation of a manual hammer. On the contrary, using the auto hammer will bring the user a lot of convenience and save labor. The concrete configuration of the auto hammer will be described hereinafter. A locking pin 18 is arranged on the housing 2 or the support 17. A locking hole 19 is provided on the member having the receiving cavity 63. When the member having the receiving cavity 63 is pushed into the shelf 17 and the locking hole 19 is just below the locking pin 18, the member having the receiving cavity 63 will be retracted into the housing and locked by pressing the locking pin 18 downwardly, with the striking rod 61 being revealed to increase the visibility of the striking rod 61. In this case, the striking end 611 of the striking rod 61 may function as a striking portion of the auto hammer. During operation, the objects to be processed, such as tenons and bricks, may be impacted by the striking rod 61 in a linear reciprocating manner, so that the function of the tool can be expanded, without being limited to knocking the fastening pieces into the objects to be processed. It will be understood for those skilled in the art that the member having the receiving cavity 63 is made from transparent material such as transparent plastic to increase the visibility of the striking rod 61. The user may use the tool as an auto hammer to strike the objects to be processed when he/she could see the specific position of the striking rod 61.

As shown in FIGS. 16-20, the striking device of the auto hammer can rotate. The striking device 6 can pivot about the central axis Z of the impact wheel 31 relative to the grip 4. The left and right rotating half-covers 20, 21 are preferably configured with symmetrical semi-circle openings 22, which may also be usually arranged with an integral configuration. The left and right rotating half-covers 20, 21 are provided with rings 23, 24. The gear housing 25 are arranged with protruding cylinders 26, 27 on both ends. During assembly, the left and right rotating half-covers 20, 21 are combined with each other, such that the two semi-circle openings 22 form an entire circle opening, into which the striking rod 61 is inserted. The small screws 28 on opposite sides of the rotating covers 20, 21 are fitted into the U-shaped slots 613, so that the striking rod 61 is axially stopped. The member having the receiving cavity 63 passes through the shelf 17 which is fixed on the left and right half-covers 30, 33 by means of screws 29. Meanwhile, the two rings 23, 24 on the left and right rotating half-covers 20, 21 are mounted on the two protruding cylinders 26, 27 of the gear housing 25, respectively. The rings 23, 24 and the cylinders 26, 27 are all arranged coaxially with the axis Z of the impact wheel 31, so that the left and right rotating half-covers 20, 21 may pivot about the axis Z. The housing 30 is composed of two symmetrical halves 30*a*, 30*b*, which are respectively fixed on the left and right rotating half-covers 20, 21 by screws (not shown). Finally, the left and right grips are combined and mounted to encircle the protruding cylinders 26, 27 on the gear housing 25. A light source 10 is arranged on the housing 30, which can rotate together with the striking device 6, so that it may light the receiving cavity 63 and the surface of the objects to be processed no matter into which position the striking device is rotated.

With reference to FIGS. 16-20, the auto hammer 1 further includes a locking mechanism 34 for restricting the pivotal movement of the striking device 6 relative to the grip 4. The locking mechanism 34 includes a button 34*a* thereon. At least one round hole 24*a* is provided on the ring 24 of the right rotating half-cover 21, within which a locking pin 34*b* and a spring are fitted. The grip 4 includes at least two round holes 4*a*. The striking device 6 is locked when the other end of the locking pin 34*b* enters into the round hole 4*a*. On the other hand, the striking device 6 can rotate when the button 34*a* is pressed and the protrusion 34*c* on the button 34*a* ejects the locking pin 34*b* out of the round hole 4*a*. The axis Y of the striking rod 61 or its parallel line Y' and the axis X of the grip 4 form an angle $\alpha$, which may vary between 60° and 180° when the striking device 6 pivots about the central axis Z of the impact wheel 31. When the striking device 6 pivots to the position shown in FIG. 18 where the angle $\alpha$ is 60° and the button 34*a* is released, the locking pin 34*b* is locked within the corresponding round hole 4*a* on the grip 4. When the button 34*a* is pressed, the locking pin 34*b* is ejected out of the round hole 4*a*, so that the striking device 6 can rotate freely to the positions as shown in FIGS. 19 and 20, where the angle $\alpha$ is 90° and 180°, respectively. It could be understood that the grip 4 may be arranged with more round holes 4*a* thereon, so that the striking device 6 may rotate freely and be locked in any position where the angle $\alpha$ is from 60° to 180°.

FIGS. 21-24 show another embodiment of the striking device 6 of the rotatable auto hammer 1. The angles $\alpha$ between the central axis Y of the striking rod 61 or its parallel line Y' and the central axis X of the grip are 60°, 110° and 180° respectively. Similarly, a locking mechanism 34 is provided in the auto hammer 1 for locking the striking device 6 and preventing the same from pivotally moving relative to the grip 4. At least one round hole 24*a* is provided on the ring 24 of the right rotating cover 21, within which a locking pin 34*b* is fitted. When the button 34*a* is pushed, the corresponding protrusion 34*c* ejects the locking pin 34*b* out of the round hole 4*a* of the grip 4 so that the striking device 6 can rotate into other positions. When the locking pin 34*b* enters into another round hole 4*a* of the grip 4, the striking device 6 is locked. With the striking rod 61 pivoting about the central axis Z of the impact wheel, the striking rod 61 may be fixed at different rotating angles. As a result, the striking device 6 can be used in various narrow spaces.

The auto hammers according to the present invention are not limited to the contents and configurations described above in the embodiments and shown in the accompanying drawings. Based on the present invention, those skilled in the art will envisage other obvious variations, replacement and modifications to the configurations and positions of the elements contained, which are also contained in the protection range of this invention.

What is claimed is:

1. An auto hammer, comprising:

a housing having a grip portion;

a motor contained within the housing;

a switch arranged on the housing for controlling the motor; and a head assembly arranged on one end of the housing;

wherein the head assembly includes a striking device having a rigid tubular member and wherein the rigid tubular member comprises a locking mechanism, and wherein the rigid tubular member as a whole is retractable into the housing and is lockable in a retracted position by the locking mechanism such that the striking device is revealed and wherein the locking mechanism releases the retracted rigid tubular member to allow free movement of the rigid tubular member relative to the housing.

2. The auto hammer according to claim 1, wherein the locking mechanism comprises a locking pin and a locking hole.

3. The auto hammer according to claim 2, wherein the locking pin is mounted on the housing and the locking hole is mounted on the rigid tubular member.

4. The auto hammer according to claim 1, wherein the rigid tubular member is made from a transparent material.

5. The auto hammer according to claim 1, wherein the head assembly includes a transmission mechanism, the transmission mechanism converts rotating motions of the motor into linear motions of the striking rod.

6. The auto hammer according to claim 1, wherein the gravity center of the auto hammer is located at the grip portion.

7. The auto hammer according to claim 1, wherein the striking device comprises a striking rod and wherein a distance from a central axis of the striking rod to a top of the head assembly is between 5 mm and 26 mm.

8. The auto hammer according to claim 7, wherein the distance between the central axis of the striking rod and the top of the head assembly is 10.7 mm.

9. The auto hammer according to claim 1, wherein a material of the head assembly is different from a material of the housing and wherein the head assembly is adapted to be held by hands during operation.

10. The auto hammer according to claim 9, wherein the material of the head assembly has a hardness that is lower than that of the material of the housing.

11. The auto hammer according to claim 10, wherein the material of the head assembly is TPE and the material of the housing is ABS.

12. The auto hammer according to claim 1, wherein a material of the grip portion is different from a material of the housing and wherein the grip portion is adapted to be held by hands during operation.

13. The auto hammer according to claim 12, wherein the material of the grip portion has a hardness that is lower than that of the material of the housing.

14. The auto hammer according to claim 13, wherein the material of the grip portion is TPE and the material of the housing is ABS.

15. The auto hammer according to claim 1, wherein the striking device comprises a striking rod and wherein, when the auto hammer is used between two surfaces perpendicular to each other with opposite sides of a top of the housing abutting against the two surfaces, the distance from a central axis of the striking rod to an intersecting line of the two surfaces is between 10 mm and 40 mm.

16. The auto hammer according to claim 15, wherein the distance from the central axis of the striking rod to the intersecting line is 28 mm.

17. The auto hammer according to claim 1, wherein the striking device comprises a striking rod and wherein the auto hammer includes an impact wheel, and a distance from an end surface of a striking end of the striking rod to a center of the impact wheel is between 40 mm to 100 mm.

18. The auto hammer according to claim 17, wherein the distance from the end surface of the striking end of the striking rod to the center of the impact wheel is 70 mm.

19. The auto hammer according to claim 1, wherein a distance between opposite sides of an upper portion of the housing is between 50 mm to 80 mm.

20. The auto hammer according to claim 19, wherein the distance between opposite sides of the upper portion of the housing is 66 mm.

21. The auto hammer according to claim 1, wherein the auto hammer further includes a light source.

22. The auto hammer according to claim 21, wherein the light source is a LED.

* * * * *